US011214927B2

(12) United States Patent
Virtanen et al.

(10) Patent No.: US 11,214,927 B2
(45) Date of Patent: Jan. 4, 2022

(54) METHOD FOR INCREASING THE STRENGTH PROPERTIES OF A PAPER OR BOARD PRODUCT

(71) Applicant: Kemira Oyj, Helsinki (FI)

(72) Inventors: Mikko Virtanen, Helsinki (FI); Kimmo Strengell, Espoo (FI); Juan Cecchini, Jyväskylä (FI); Matti Hietaniemi, Espoo (FI)

(73) Assignee: Kemira Oyj, Helsinki (FI)

( * ) Notice: Subject to any disclaimer, the term of this patent is extended or adjusted under 35 U.S.C. 154(b) by 83 days.

(21) Appl. No.: 16/610,101

(22) PCT Filed: Jun. 13, 2018

(86) PCT No.: PCT/FI2018/050447
§ 371 (c)(1),
(2) Date: Nov. 1, 2019

(87) PCT Pub. No.: WO2018/229333
PCT Pub. Date: Dec. 20, 2018

(65) Prior Publication Data

US 2020/0080264 A1 Mar. 12, 2020

(30) Foreign Application Priority Data

Jun. 14, 2017 (FI) ..... 20175551

(51) Int. Cl.

| | |
|---|---|
| ***D21F 1/02*** | (2006.01) |
| ***D21H 21/20*** | (2006.01) |
| ***D21F 9/00*** | (2006.01) |
| ***D21F 11/04*** | (2006.01) |
| ***D21H 11/14*** | (2006.01) |
| ***D21H 17/25*** | (2006.01) |
| ***D21H 17/28*** | (2006.01) |
| ***D21H 17/42*** | (2006.01) |
| ***D21H 17/45*** | (2006.01) |
| ***D21H 27/38*** | (2006.01) |

(52) U.S. Cl.
CPC ..... *D21H 21/20* (2013.01); *D21F 1/02* (2013.01); *D21F 9/006* (2013.01); *D21F 11/04* (2013.01); *D21H 11/14* (2013.01); *D21H 17/25* (2013.01); *D21H 17/28* (2013.01); *D21H 17/42* (2013.01); *D21H 17/45* (2013.01); *D21H 27/38* (2013.01)

(58) Field of Classification Search
USPC ..... 162/127
See application file for complete search history.

(56) References Cited

U.S. PATENT DOCUMENTS

| | | | |
|---|---|---|---|
| 2003/0155071 | A1 | 8/2003 | Werres et al. |
| 2004/0144510 | A1 | 7/2004 | Mauler |
| 2012/0118523 | A1 | 5/2012 | Lu et al. |
| 2013/0180680 | A1 | 7/2013 | Axrup et al. |

FOREIGN PATENT DOCUMENTS

| | | | |
|---|---|---|---|
| EP | 2784213 | A1 | 10/2014 |
| EP | 2784214 | A1 | 10/2014 |
| WO | 2004031478 | A1 | 4/2004 |
| WO | 2012039668 | A1 | 3/2012 |
| WO | 2014029917 | A1 | 2/2014 |
| WO | 2015036930 | A1 | 3/2015 |

OTHER PUBLICATIONS

Finnish Patent and Registration Office, Search Report of Finnish patent application FI20175551, dated Dec. 22, 2017, 1 page.

*Primary Examiner* — Mark Halpern
(74) *Attorney, Agent, or Firm* — Meunier Carlin & Curfman LLC

(57) ABSTRACT

A method is disclosed for increasing strength properties, preferably burst strength and SCT strength, of a paper or board product. The paper or board product is manufactured from a fibrous web produced by a multilayer headbox, where an aqueous layer is formed between at least a first and a second fibre layer formed from fibrous stock suspension(s), and where feed water for the aqueous layer includes at least one cationic polymer. The method of the invention includes adding an anionic additive selected from a group comprising anionic synthetic organic polymers, anionic polysaccharides, and any of their combinations to the feed water before formation of the aqueous layer.

16 Claims, No Drawings

METHOD FOR INCREASING THE STRENGTH PROPERTIES OF A PAPER OR BOARD PRODUCT

PRIORITY

This application is a U.S. national application of the international application number PCT/FI2018/050447 filed on Jun. 13, 2018 and claiming priority of Finnish application 20175551 filed on Jun. 14, 2017 the contents of all of which are incorporated herein by reference.

The present invention relates to a method for increasing the strength properties, preferably burst strength and SCT strength, of a paper or board product according to the preambles of enclosed independent claims.

Multilayer headboxes in paper or board machines are known in the art of paper and board making. Multilayer headboxes are used to produce layered webs by using a single headbox and forming unit, typically with gap former applications, where the web can be immediately drained to both sides. Production of layered paper or board structures with one headbox enables optimisation of raw materials used in each layer. Multilayer headboxes provide also economical benefits, as fewer forming units are needed. However, multilayer headboxes have additional demands, for example, on structured sheet formation.

It is known to feed a thin layer of water in form of an even film between adjacent fibre stock layers formed by the multilayer headbox. This so-called aqua layering technology uses the thin water layer as a headbox wedge to stabilise the fibre stock layers, and the created thin water layer prevents mixing of the adjacent fibre stock layers. It is also known that functional additives may be fed to the feed water forming the water layer. For example, EP 2 784 214 discloses a multilayer headbox for a paper or board machine, which is capable of forming an aqueous layer between two adjacent stock layers. The feed water supply of the headbox additionally comprises a feeding and dosing device for feeding and dosing an additive which is a cationic polymer into the feed water. However, for many applications a further strength improvement may be desired or needed.

An object of this invention is to minimise or even eliminate the disadvantages existing in the prior art.

An object is also to provide a method, which enables production of paper or board with increased strength properties, especially SCT strength and burst strength.

A further object of this invention is to provide a method with which the retention of the cationic polymer to the formed web is improved.

These objects are attained with the invention having the characteristics presented below in the characterising part of the independent claim. Some preferable embodiments are disclosed in the dependent claims.

The embodiments mentioned in this text relate, where applicable, to all aspects of the invention, even if this is not always separately mentioned.

In a typical method according to the present invention for increasing the strength properties, preferably burst strength and SCT strength, of a paper or board product, manufactured from a fibrous web produced by a multilayer headbox, where an aqueous layer is formed between at least a first and a second fibre layer formed from fibrous stock, and where feed water for the aqueous layer comprises at least one cationic polymer, the method further comprises an addition of an anionic additive, which is selected from anionic synthetic organic polymers, anionic polysaccharides, such as anionic starch, or any of their combinations, to the feed water before formation of the aqueous layer.

A typical use of the method according to invention is for increasing the strength properties, preferably burst strength and SCT strength, of a paper or board product produced by a multilayer headbox.

Now it has been surprisingly found that an addition of an anionic additive, either an anionic synthetic organic polymer or anionic polysaccharide, such as anionic starch, or their combination to the feed water, which forms the aqueous layer between the fibrous layers in a multilayer headbox using so-called aqua layering technique, increases significantly the strength properties of the final paper or board. It is assumed, without being bound by a theory, that the anionic additive forms some kind of polyelectrolyte complex with the cationic polymer present in the feed water. This formed complex is efficiently retained by the adjacent stock layers during the dewatering of the web. The anionic additive, preferably anionic synthetic polymer, increases the viscosity of the feed water as the anionic additive interacts with the cationic polymer, and this increases the drainage resistance and shear resistance of the system. In this manner the loss of the cationic polymer to the circulating waters is minimised and an increased strength for the formed product is achieved. In practice this enables the production of paper and board products with lighter grammage, which still satisfy the strength specifications. This provides also savings in used raw materials and energy, and reduces the carbon footprint of the produced products.

The present invention relates to production of a fibrous web by a multilayer headbox, where an aqueous layer of feed water is formed between at least a first stock layer and a second stock layer formed from fibrous stock, comprising cellulosic fibres. The stock layers and the aqueous layer of feed water are formed simultaneously by using a single multilayer headbox. The feed water layer is dewatered through the stock layers during the formation of the web. After the web is formed it is dried and processed as conventional in the art of paper or board making.

In the present context the terms "stock layer", "fibre stock layer", "fibre layer" and "fibrous layer" are used interchangeably and synonymously. All these terms encompass various aqueous suspensions of lignocellulosic fibres that are used to form webs or layers, which form a layer of the final multi-layered paper or board product. The consistency of fibre stock at the headbox is usually 3-20 g/l.

According to one preferable embodiment of the invention the feed water further comprises cellulosic fibre material selected from unrefined cellulosic fibres, refined cellulosic fibres and/or microfibrillated cellulose fibrils. Refined cellulosic fibres may have a refining level of at least 30° SR, preferably at least 50° SR, more preferably at least 70° SR. In context of the present application the abbreviation "SR" denotes Schopper-Riegler value, which is obtained according to a procedure described in standard ISO 5267-1:1999. In the context of the present application the term "microfibrillated cellulose" is synonymous with the term "nanofibrillated cellulose" and may include fibre fragments, fibrillary fines, fibrils, micro fibrils and nanofibrils. In general, microfibrillated cellulose is here understood as liberated semi-crystalline cellulosic fibril structures having high length to width ratio or as liberated bundles of nanosized cellulose fibrils. Microfibrillated cellulose has a diameter of 2-60 nm, preferably 4-50 nm, more preferably 5-40 nm, and a length of several micrometers, preferably less than 500 μm, more preferably 2-200 μm, even more preferably 10-100 μm, most preferably 10-60 μm. Microfibrillated cellulose comprises often bundles of 10-50 microfibrils. Microfibrillated cellulose may have high degree of crystallinity and high degree of polymerization, for example the degree of polymerisation DP, i.e. the number of monomeric units in a polymer, may be 100-3000.

Often the feed water comprises white water from the drainage of the formed web, which means that there are variable amounts of cellulosic material, such as fibres, fibre fragments and/or fibrils present in the feed water. However, it is possible to add cellulosic material, as described above, especially refined cellulosic fibres and/or microfibrillated cellulose to the feed water in order to enhance the retention of added chemicals, especially cationic polymer. The cellulosic fibre material functions as a carrier for the cationic polymer and may increase the size of the formed polyelectrolyte complexes.

The feed water may comprise <30 weight-%, preferably 1-15 weight-%, more preferably 2-15 weight-%, even more preferably 5-10%, of cellulosic fibre material. When the cellulosic fibre material is microfibrillated cellulose or nanofibrillated cellulose, the amount of fibre material may be lower, preferably 1-5 weight-%. The percentages are calculated from the produced paper or board product. The amount of cellulosic fibre material allows the addition of cationic polymer in amount that provides efficient strength increase but does not reduce or destroy the drainage properties of the formed web.

In some embodiments the feed water is practically free from cellulosic fibre material, especially from unrefined cellulosic fibres and/or refined cellulosic fibres. The amount of cellulosic fibre material in the feed water, may be 15 weigh-%, preferably 0-10 weight-%, more preferably 0.1-9 weight-%, even more preferably 3-8 weight-%, calculated from the produced paper or board product.

If any cellulosic fibre material is present in the feed water, the consistency of the feed water is, however, lower than consistency of the fibre suspension forming the first and the second fibre layer. According to one preferable embodiment of the invention the consistency of the feed water is less than 10 g/l, preferably less than 8 g/l, more preferably less than 6 g/l.

Feed water is used to form an aqueous layer between at least a first and a second fibre stock layer formed from fibrous stock. According to one embodiment of the invention the consistency of the aqueous layer situated between the first and second fibre stock layer may be at most 80%, preferably at most 60% of the consistency of the adjacent first and/or second fibre stock layer. According to one embodiment the consistency of the aqueous layer is 10-80%, more preferably 30-60%, of the consistency of the adjacent first and/or second fibre stock layer. In case the adjacent first and second stock layers have different consistencies, the suitable value for the consistency of the aqueous layer is determined on basis of the stock layer which has the lowest consistency.

All consistency values in this application are determined according to standard SCAN-M1:64, using ashless/White ribbon filter paper Whatman 589/2 or equivalent in the Büchner funnel.

The feed water may, in addition to cellulosic fibre material, comprise inorganic mineral particles originating from recycled fibre raw material or broke, as well as other wire water substances commonly present. The ash content in the feed water may be, for example, 5 weight-% or higher. Typically, the ash content of the feed may be 5-50 weight-%, more preferably 10-30 weight-%. Standard ISO 1762, temperature 525° C. is used for ash content measurements.

The pH of the feed water may be around 5, but typically the pH of the feed water is >5, preferably >6 or >7. At higher pH values, for example pH>6 or >7, the charged groups of anionic additive, such as carboxyl groups of anionic polyacrylamide, are dissociated in a higher degree. This means that more anionically charged sites are available for interaction with the cationic starch, and a higher strength improvement may be obtained.

The charge density of the anionic additive may be in the range of −0.05--5 meq/g dry polymer, preferably −0.1--4 meq/g dry polymer, more preferably −0.5--4 meq/g dry polymer, at pH 7. This provides good interaction with the cationic starch.

Anionic additive may have a weight average molecular weight >100 000 g/mol, preferably >250 000 g/mol.

According to one preferable embodiment of the present invention the anionic additive is or comprises an anionic synthetic organic polymer, which is selected from copolymers of (meth)acrylamide and anionic monomers, i.e. the additive is or comprises anionic polyacrylamide. The anionic monomers may preferably be selected from unsaturated mono- or dicarboxylic acids, such as acrylic acid, maleic acid, fumaric acid, itaconic acid, aconitic acid, mesaconic acid, citraconic acid, crotonic acid, isocrotonic acid, angelic acid, tiglic acid, any salt thereof and any of their mixtures. The copolymer of acrylamide may have an anionicity in the range of 2-70 mol-%, preferably 2-50 mol-%, more preferably 5-35 mol-%, even more preferably 5-11 mol-%. The anionicity of the copolymer relates to the amount of structural units in the copolymer which originate from anionic monomers. It has been observed that this anionicity, and especially the lower anionicity ranges, provides an excellent interaction with the cationic polymer as well as adsorption to the stock layers.

The anionic copolymer of acrylamide may be obtained, for example, by solution polymerisation or emulsion polymerisation. It may also be partially hydrolysed anionic polyacrylamide or glyoxalated anionic copolymer of acrylamide.

The anionic copolymer of acrylamide may have a weight average molecular weight MW<5 000 000 g/mol, preferably <2 500 000 g/mol, more preferably <1 500 000 g/mol. According to one embodiment the weight average molecular weight of the copolymer of acrylamide is in the range of 100 000-5 000 000 g/mol, preferably 250 000-2 500 000 g/mol, more preferably 300 000-1 500 000 g/mol. It has been found that acrylamide copolymers with small molecular weight are preferable, as they can be dosed to the feed flow in larger amounts without risk of floc forming when the polymer comes into contact with the cationic polymer and cellulosic fibre material. As the dosage amount can be increased, the result is a further improvement in obtained strength properties.

According to another embodiment the copolymer of acrylamide may have a weight average molecular weight MW>5 000 000 g/mol, sometimes >7 500 000 g/mol, sometimes even >15 000 000 g/mol. In case the acrylamide copolymer has the weight average molecular weight >5 000 000 Da it is typically used with an auxiliary agent, such as alum or polyaluminium chloride. In this case, the cationic starch and anionic polyacrylamide are combined and thereafter an auxiliary agent is added.

According to another embodiment of the invention the anionic additive comprises anionic polysaccharide. In the present context polysaccharides are understood as natural polymers formed from polymeric carbohydrate molecules, which comprise long chains of monosaccharide units as repeating units bound together by covalent bonds. Polysaccharides may be extracted from various botanical sources, microorganisms, etc. Polysaccharide chains contain multiple hydroxyl groups capable of hydrogen bonding. Anionic polysaccharide contains anionic groups in the polysaccharide structure. Such anionic groups may be naturally present in the polysaccharide structure or they may have been introduced by suitable chemical modification of the polysaccharide structure. Anionic groups may be provided e.g. by incorporating to the polysaccharide structure carboxyl, sulphate, sulphonate, phosphonate or phosphate groups, including their salt forms, or combinations thereof. Anionic groups may be introduced to the polysaccharide structure by suitable chemical modification including carboxymethylation, oxidation, sulphation, sulphonation and phosphorylation. Anionic polysaccharides, which are suitable for use as anionic additives, may comprise anionically derivatized celluloses, anionically derivatized starches, or any combinations thereof, including modified celluloses and starches, such as hydroxyethyl cellulose, hydroxyethyl starch, ethylhydroxyethyl cellulose, ethylhydroxyethyl starch, hydroxypropyl cellulose, hydroxypropyl starch, hydroxypropyl hydroxyethyl cellulose, hydroxypropyl hydroxyethyl starch, methyl cellulose, methyl starch, and the like.

According to one preferable embodiment of the invention the anionic additive comprises anionic polysaccharide, which may be selected from a group consisting of anionic carboxymethylated cellulose, anionic starch or any combination thereof According to one preferable embodiment the anionic additive comprises carboxymethylated cellulose, even more preferably carboxymethyl cellulose. Anionic additive may comprise, for example, purified carboxymethyl cellulose or technical grade carboxymethyl cellulose. The carboxymethylated cellulose may be manufactured by any process known in the art. Carboxymethylated cellulose, preferably carboxymethyl cellulose, may have a degree of carboxymethyl substitution >0.2, preferably in the range of 0.3-1.2, more preferably 0.4-1.0. In one preferable embodiment the carboxymethylated cellulose may have a degree of carboxymethyl substitution in the range of 0.5-0.9, which provides essentially complete water-solubility for the carboxymethyl cellulose.

According to one embodiment of the invention the anionic additive comprises anionic polysaccharide, which comprises carboxymethylated cellulose, preferably carboxymethyl cellulose, which may have a charge density value below −1.1 meq/g dry polymer, preferably in the range of −1.6--4.7 meq/g dry polymer, more preferably −1.8--4.1 meq/g dry polymer, even more preferably −2.5--4.0 meq/g dry polymer, when measured at pH 7. All measured charge density values are calculated per weight as dry.

According to one embodiment of the invention the anionic additive comprises carboxymethylated cellulose, preferably carboxymethyl cellulose, which may have viscosity in the range of 30-30 000 mPas, preferably 100-20 000 mPas, more preferably 200-15 000 mPas, measured from 2 weight-% aqueous solution at 25° C. The viscosity values are measured by using Brookfield LV DV1, equipped with small sample adapter, at 25° C. Spindle is selected based on Brookfield equipment manual and tested with maximum rotational speed (rpm) allowed.

According to another embodiment of the invention the anionic additive is or comprises anionic starch. Anionic starch may have anionic substitution degree of 0.005-0.1, preferably 0.008-0.05. Anionic substitution degree describes the number of hydroxyl groups that have been substituted per anhydroglucose unit in the starch. The anionic substituents may be introduced to the starch molecule by any known method, for example by chemical modification, such as phosphonation, phosphorylation, sulphation, sulphonation, esterification, etherification, oxidation, and/or grafting of anionic functionalities on the starch molecule structure. The anionic starch may comprise, for example, starch phosphonate, starch phosphate, carboxyalkylated starch, starch sulphate, sulphoalkylated starch, sulphocarboxyalkylated starch, starch sulphonate, and/or oxidized starch.

The anionic starch may have charge density of −0.03--0.5 meq/g dry starch, preferably −0.05--0.3 meq/g dry starch.

According to one preferable embodiment the anionic additive comprises anionic starch may have a weight average molecular weight >1 000 000 g/mol, preferably 10 000 000 g/mol, more preferably >1 000 000 000 g/mol. The anionic starch is used in a dissolved form. The dissolving of anionic starch may be made e.g. by cooking the starch in the temperature of 70-150° C., preferably at 115-150° C., e.g. at jet cooker apparatus.

The anionic additive may also be a combination of anionic synthetic organic polymer and anionic polysaccharide, such as anionic starch or carboxymethylated cellulose. The anionic synthetic polymer may have been polymerised in the presence of anionic polysaccharide, such as anionic starch, or the anionic additive may be a mixture of anionic synthetic organic polymer and anionic polysaccharide, such as anionic starch or carboxymethylated cellulose.

The anionic additive may also contain cationic groups, as long as the net charge of the additive is anionic. For example, the anionic additive may be anionic copolymer of acrylamide, which has anionic net charge but have some cationic groups present in its structure. Alternatively, the anionic additive may be a mixture of anionic synthetic organic polymer and/or anionic polysaccharide, such as anionic starch, and a cationic component, such as cationic starch, as long as the net charge of the mixture, i.e. anionic additive, is anionic.

The anionic additive, i.e. anionic synthetic organic polymer or anionic polysaccharide, such as anionic starch, or their combination, may be added in amount, which maintains the sum of the added charges from cationic polymer(s), anionic additive and cellulosic fibre material, added to the feed water, net cationic. When the sum of the charges of components added to the feed water is net cationic the retention of the strength inducing cationic polymer, such as cationic starch, to the stock layers is enhanced.

The anionic additive is added to the feed water before it exits from the headbox. The anionic additive, preferably anionic synthetic organic polymer, is preferably added to the feed water separately from the cationic polymer. The anionic additive may be added before or after the addition of the cationic polymer, preferably after the addition of the cationic polymer, i.e. to feed water already comprising a cationic polymer. It has been observed that the interaction between the anionic additive and the cationic polymer is effective when the anionic additive is added after the cationic polymer.

The cationic polymer that is added to the feed water may be or comprise cationic starch or a cationic synthetic strength polymer. The cationic synthetic strength polymer may be, for example, glyoxalated cationic polymer (GPAM), homo- or copolymer of diallyldimethylammonium chloride (DADMAC), cationic polyacrylamide, polyamine, polyamidoamine, polyamidoamine epichlorohydrin, polyvinylamine, polyethyleneimine, or any combination thereof. When the cationic polymer is a cationic synthetic strength polymer it may be added to the feed water in amount of 0.5-3.5 kg/ton of feed fibres, preferably 1-3 kg/ton of feed fibres.

According to one preferable embodiment of the present invention the cationic polymer is or comprises cationic starch, which may be added in amount of 3-20 kg/ton of feed fibres, preferably 6-14 kg/ton of feed fibres, more preferably 9-13 kg/ton of feed fibres. These starch amounts provide improved and increased strength properties to the final paper or board, compared to known aqua layering techniques without addition of anionic synthetic polymer. As a result it is possible to produce paper or board with increased burst or SCT strength while using the same amount of cationic starch.

The cationic starch may be any wet-end starch conventionally used for increasing the strength of paper or board. The cationic starch is cooked before its use. The cationic starch is added preferably solely to the feed water, i.e. the stock layers are free of added cationic starch.

It is possible to add one or more auxiliary agents to the feed water. Examples of suitable auxiliary agents are alum and anionic microparticles, especially anionic silica microparticles or bentonite microparticles. With addition of auxiliary agents it is possible to modify the interaction between the anionic additive and the cationic polymer and or cellulosic fibre material.

According to one embodiment of the invention the first and/or the second stock layer comprise, in addition to cellulosic fibres, anionic microparticles and cationic synthetic polymer(s), e.g. cationic synthetic flocculant. Anionic microparticles may be anionic silica microparticles or bentonite microparticles and the cationic synthetic polymer may be a cationic polyacrylamide flocculant with high molecular weight. Anionic microparticles and the cationic synthetic polymer(s) in the first and/or second stock layer form an effective retention aid that enhances the capture of the complex formed in the feed water layer from synthetic anionic organic polymer, cationic polymer and optional cellulosic fibre material, when the feed water layer is drained through the stock layers.

The invention described herein is especially suitable for manufacturing processes of paper or board using recycled fibres. According to one embodiment the fibre stock used for forming the first and/or second stock layer may comprise recycled cellulosic fibres originating from old corrugated containerboard (OCC) and/or recycled fibre material. OCC may comprise used recycled unbleached or bleached kraft pulp fibres, hardwood semi-chemical pulp fibres, grass pulp fibres or any mixture thereof. According to one embodiment of the invention the fibre stock comprises at least 20 weight-%, preferably at least 50 weight-%, of fibres originating from OCC or recycled fibre material. In some embodiments, the fibre stock may comprise even >70 weight-%, sometimes even >80 weight-%, of fibres originating from OCC or recycled fibre material.

Addition of anionic additive improves the strength properties of the final paper or board, especially the SCT strength and burst strength. These are important strength properties for paper and board, especially for grades used for packaging. Short-span Compression Test (SCT) strength may be used to predict the compression resistance of the final product, e.g. cardboard box. Burst strength indicates paper's/board's resistance to rupturing, and it is defined as the hydrostatic pressure needed to burst a sample when the pressure is applied uniformly across the side of the sample. Both the compression strength and burst strength are normally negatively affected when the amount recycled fibres in the original stock is increased. The anionic additive may improve internal bond strength as indicated by Z-directional tensile or Scott Bond strength values. This is beneficial for multiply boards, such as white lined chip board or core board.

Also, the problems of low internal bond strength can be solved in manufacture of high basis weight testliner grades. In many board grades high enough internal bond strength is needed for converting and/or printing. In testliner manufacturing the strength properties are conventionally enhanced by size press starch treatment. However, size press starch cannot penetrate throughout the structure, if the basis weight of the sheet is high, such as >130 g/m$^2$. Therefore, in conventional processes there is a risk that the internal bond strength remains weak in the middle of sheet in Z-direction. The strength system according to present invention can be added between the various layers, which solves the problem.

According to one preferable embodiment the paper or board product, which is produced with the help of the present invention, is a test liner, fluting, kraft liner, white top liner, white top test liner, white lined chip board, folding boxboard, chip board, liquid packaging board, core board, solid bleached board, wall paper, gypsum or plaster board, carrier board, or cup board. All these paper or board products benefit clearly from the combined improvement of SCT strength and burst strength. Preferably the grammage of the produced paper or board product is in the range of 70 to 350 g/m$^2$.

EXPERIMENTAL

An embodiment of the invention is described more closely in the following non-limiting example.

Example 1

Technical performance of anionic additive in a water layer of a multilayer headbox together with cationic starch was tested with a pilot paper machine and by using recycled furnish. Characteristics of paper testing devices and methods which were employed are given in Table 1. Chemicals used in Example 1 are described in Table 2.

The furnish used in the pilot paper machine trial comprised refined recycled fibres at top layer and unrefined recycled fibres at back layer and refined recycled fibres to water layer.

TABLE 1

Paper testing devices and standards used in Example 1.

| Measurement | Device | Standard |
|---|---|---|
| Basis weight | Mettler Toledo | ISO 536 |
| Short compression test, SCT | Lorenzen & Wettre | ISO 9895 |
| Burst strength | Lorenzen & Wettre | ISO 2758 |
| Tensile strength (geometrical) | Lorenzen & Wettre | ISO 1924-3 |

TABLE 2

Chemicals used in Example 1

| Abbreviation | Composition/Product, Manufacturer | Description |
|---|---|---|
| Starch | Cationic starch, cooked | cationic charge density 0.27 meq/g dry |
| APAM | Copolymer of acrylamide and acrylic acid, Kemira Oyj Finland | 8 mol-% anionic, MW ~0.5 Mg/mol |
| CPAM | Cationic polyacrylamide flocculant, HMW, Kemira Oyj Finland | Dry polymer dissolved at 0.5% concentration |
| Silica | Colloidal silica sol/FennoSil 5000, Kemira Oyj Finland | Anionic colloidal silica sol |

In the pilot paper machine trial chemicals were added in following dosing points: Refined recycled fibres to water layer before feed pump, starch to water layer before feed pump just after the addition of refined recycled fibres, APAM to water layer after feed pump, retention CPAM to top and back ply furnish before screen and colloidal silica to top and back ply furnish after screen.

Before testing the paper samples, sheets were pre-conditioned for 24 h at 23° C. in 50% relative humidity, according to ISO 187.

Test points and indexed strength results are presented in Table 3. Results showed that APAM dosed together with cationic starch and fibers in water layer improved clearly the strength properties of the recycled paperboard. Especially it was found that APAM is able to provide a local maximum for both SCT strength and tensile strength with improved burst strength. SCT and burst strength are the main strength specifications for recycled board.

TABLE 3

Test points and indexed strength results. Dosages as dry. All points include CPAM 300 g/t and colloidal silica 450 g/t in top and back ply.

| Test point | SCT Index CD | Burst index | Tensile index |
|---|---|---|---|
| Refined recycled fibres 7%, Starch 12 kg/t | 100 | 100 | 100 |
| Refined recycled fibres 7%, Starch 12 kg/t, APAM 0.4 kg/t | 105.8 | 107.1 | 103.9 |

TABLE 3-continued

Test points and indexed strength results. Dosages as dry. All points include CPAM 300 g/t and colloidal silica 450 g/t in top and back ply.

| Test point | SCT Index CD | Burst index | Tensile index |
|---|---|---|---|
| Refined recycled fibres 7%, Starch 12 kg/t, APAM 0.8 kg/t | 110.4 | 113.8 | 106.8 |
| Refined recycled fibres 7%, Starch 12 kg/t, APAM 1.2 kg/t | 101.7 | 116 | 101.8 |

Example 2

Technical performance of anionic additive in an aqueous layer of a multilayer headbox together with cationic starch was tested with a dynamic handsheet former. The test furnish was recycled fiber made from European testliner board sheets.

Test fibre stock was made to simulate recycled fibre. Central European testliner board, having ash content about 15% and comprising about 5% surface size starch, was used as raw material. Dilution water was prepared from tap water, where $Ca^{2+}$ concentration was adjusted to 520 mg/l with $CaCl_2$), and conductivity to 4 mS/cm with NaCl. Testliner board was cut to 2×2 cm squares. 2.7 l of dilution water was heated to 70° C. The testliner squares were wetted for 10 minutes in dilution water at 2% concentration before disintegration in Britt jar disintegrator with 30 000 rotations.

Disintegrated pulp was diluted to 0.8% consistency for first and second fibre layers by adding dilution water.

A part of the disintegrated pulp, which was intended to be used in water layer, was further refined in Valley Hollander at 1.75% consistency until refining degree SR 60 was reached. Water layer was obtained by dilution of refined fibres to 0.4% consistency by using dilution water.

Consistency determinations were made according to SCAN-M1:64 standard using ashless white ribbon filter paper Whatman 589/2 in the Büchner funnel.

Chemicals used in Example 2 and their preparation are described in Table 4.

TABLE 4

Test chemicals for Example 2 and their preparation.

| Chemical name | Composition, Product name, Supplier | Properties | Preparation |
|---|---|---|---|
| C-Starch | Cationic potato starch cationic substitution DS 0.035 | | 30 min cooking at 97° C. at 1% concentration |
| A-starch | Anionic starch anionic substitution DS 0.015 (about −0.07 meq/g) | Brookfield LV DVI viscosity 7800 mPas at 2%, 25° C. | 30 min cooking at 97° C. at 1% concentration |
| CPAM-2 | 10 mol-% cationic polyacrylamide | 6M g/mol molecular weight | Dissolving at 0.5% conc. 60 min, dilution to 0.05% conc. |
| Silica-2 | Structured silica FennoSil 2180, Kemira | 8% dry solids | Diluted to 0.5% |
| CMC-1 | CMC, DS 0.7 (about −4 meq/g), 300 000 g/mol | Brookfield LV DVI viscosity 190 mPas at 2% 25° C. | dissolved in 50° C. at 1% conc. for 60 min |
| CMC-2 | CMC DS 0.4 (about −2 meq/g), 400 000 g/mol | Brookfield LV DVI viscosity 16 000 mPas at 2% 25° C. | dissolved in 50° C. at 1% conc. for 60 min. |

TABLE 4-continued

Test chemicals for Example 2 and their preparation.

| Chemical name | Composition, Product name, Supplier | Properties | Preparation |
|---|---|---|---|
| APAM | anionic polyacrylamide, 8 mol-% acrylic acid, ~500 000 g/mol | | diluted to 1% conc. |

Test fibre stock was added to dynamic hand sheet former Formette by Techpap. Chemical additions were made to mixing tank of Formette according to Table 5. All chemical amounts are given as kg dry chemical per ton dry fibre stock. Drum was operated with 1000 rpm, mixer for pulp 400 rpm, pulp pump 1100 rpm/min, all the pulps were sprayed.

First fibre layer of 47 g/m$^2$ (back ply) was formed first. Then water layer with 6 g/m$^2$ of refined recycled pulp (SR 60) was formed, and finally was formed the second fibre layer of 47 g/m$^2$ (top ply). All the water was drained at the end. Scoop time was 60 s. Sheet was removed from drum between wire and 1 blotting paper on the other side of the sheet. Wetted blotting paper and wire were removed. Sheets were wet pressed at Techpap nip press with 4.5 bar pressure with 2 passes having new blotting paper each side of the sheet before each pass. Sheets were cut to 15×20 cm rectangles. Sheets were dried in restrained condition in STFI restrained dryers 10 min at 130° C.

TABLE 5

Chemical additions in Example 2.

| | Layer | | | | | | |
|---|---|---|---|---|---|---|---|
| | top/back | top/back | water layer | water layer | water layer | water layer | water layer |
| | Time [s] | | | | | | |
| | −20 | −10 | −40 | −30 | −15 | −15 | −15 |
| | Chemical | | | | | | |
| Test No | CPAM-2 [kg/t dry] | Silica-2 [kg/t dry] | Pulp, SR 60 [kg/t dry] | C-Starch [kg/t dry] | APAM [kg/t dry] | CMC-2 [kg/t dry] | CMC-1 [kg/t dry] |
| 1 (ref.) | 0.1 | 0.15 | 60 | | | | |
| 2 (ref.) | 0.1 | 0.15 | 60 | 20 | | | |
| 3 | 0.1 | 0.15 | 60 | 20 | 3 | | |
| 4 | 0.1 | 0.15 | 60 | 20 | | 1.5 | |
| 5 | 0.1 | 0.15 | 60 | 20 | | 3 | |
| 6 | 0.1 | 0.15 | 60 | 20 | | | 1.5 |
| 7 | 0.1 | 0.15 | 60 | 20 | | | 3 |

Before testing in the laboratory sheets were pre-conditioned for 24 h at 23° C. in 50% relative humidity, according to ISO 187. Basis weight was measured according to ISO 536 and bulk according to ISO 534. Z-directional tensile (ZDT) was measured according to ISO 15754. Short span compression strength (SCT) was measured in cross direction (CD) according to ISO 9895. Bursting strength (Burst) was measured according to Tappi T 569. SCT and burst were indexed by dividing strength value by basis weight of the sheet.

The test results are presented in Table 6. Test 1 is a comparative example without strength agents, and Test 2 is a comparative example with cationic starch but without anionic additive. Test 3 with APAM as anionic additive shows improvement in Z-directional tensile, in burst and in SCT values. Tests 4-7 with CMC as anionic additive indicate improvement in burst and SCT values. The Z-directional tensile is dependent on bulk. For multi-ply board improving the ratio of Z-directional strength to bulk is important. The ratio was improved in Tests 3-7 compared to comparative Tests 1-2. Test 5 improved the bulk when Z-directional tensile was constant compared to Test 1.

TABLE 6

Test results for Example 2.

| Test | Bulk [cm$^3$/g] | Z-directional tensile [kPa] | Burst index [kPam$^2$/g] | SCT (CD) index [Nm/g] |
|---|---|---|---|---|
| 1 | 1.8 | 500 | 2.27 | 15.5 |
| 2 | 1.8 | 540 | 2.38 | 16.5 |
| 3 | 1.8 | 550 | 2.43 | 16.6 |
| 4 | 1.8 | 590 | 2.45 | 17.1 |

TABLE 6-continued

Test results for Example 2.

| Test | Bulk [cm$^3$/g] | Z-directional tensile [kPa] | Burst index [kPam$^2$/g] | SCT (CD) index [Nm/g] |
|---|---|---|---|---|
| 5 | 2.0 | 500 | 2.73 | 22.9 |
| 6 | 1.9 | 600 | 2.38 | 17.2 |
| 7 | 1.8 | 620 | 2.49 | 16.9 |

Example 3

Technical performance of anionic additive in a water layer of a multilayer headbox together with cationic starch was tested with a dynamic handsheet former. Central European testliner board, having ash content about 17% and comprising about 5% surface size starch, was used as raw material for furnish.

The anionic additive was anionic starch A-starch, see Table 4. The example 3 was carried out with similar procedure than in Example 2, but conductivity was adjusted to 3 mS/cm. The chemical additions, sheet ash and SCT (CD) strength results are presented in Table 7. It is seen that test 9 and test 10, which are according to invention, resulted good SCT-strength and improved ash retention to the sheet.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

TABLE 7

The chemical additions and results of Example 3.

| | Layer | | | | | | |
|---|---|---|---|---|---|---|---|
| | top/back | top/back | water layer | water layer | water layer | | |
| | Time [s] | | | | | | |
| Test | −20 CPAM-2 [kg/t dry] | −10 Silica-2 [kg/t dry] | −40 Pulp, SR 60 [kg/t dry] | −30 C-Starch [kg/t dry] | −15 A-Starch [kg/t dry] | Ash 525° C. [%] | SCT (CD) index [Nm/g] |
| 8 | 0.1 | 0.15 | 60 | | | 12.4 | 13.6 |
| 9 | 0.1 | 0.15 | 60 | 15 | 1.75 | 13.7 | 13.9 |
| 10 | 0.1 | 0.15 | 60 | 15 | 2.75 | 14.2 | 15.5 |

The invention claimed is:

1. A method for increasing strength properties of a paper or board product, manufactured from a fibrous web produced by a multilayer headbox, where an aqueous layer is formed between at least a first and a second fibre layer formed from fibrous stock suspension(s), and where feed water for the aqueous layer comprises at least one cationic polymer, and wherein the method comprises adding an anionic additive selected from the group consisting of copolymers of acrylamide and anionic monomers, a carboxymethyl cellulose having a degree of carboxymethyl substitution in a range of 0.4-1.2, and any of their combinations to the feed water before formation of the aqueous layer.

2. The method according to claim 1, wherein the feed water further comprises a cellulosic fibre material selected from unrefined cellulosic fibres, refined cellulosic fibres, microfibrillated cellulose fibrils and/or nanocellulose fibrils.

3. The method according to claim 2, wherein the feed water comprises 1-15 weight % of cellulosic fibre material, based on produced paper or board product.

4. The method according to claim 1, wherein a consistency of the feed water is lower than a consistency of the fibrous suspension(s) forming the first and the second fibre layer.

5. The method according to claim 1, wherein the anionic additive has a weight average molecular weight >100 000 g/mol, or a charge density of −0.05--5 meq/g dry polymer, or both.

6. The method according to claim 1, wherein the anionic additive is a carboxymethylated cellulose having:

a charge density value below −1.1 meq/g dry polymer, measured at pH 7, or viscosity in a range of 30-30 000 mPas, measured from 2 weight-% aqueous solution at 25° C. by using Brookfield LV DV1, or both.

7. The method according to claim 1, wherein the copolymer of acrylamide has a weight average molecular weight <5 000 000 g/mol.

8. The method according to claim 1, wherein the copolymer of acrylamide has an anionicity in a range of 2-70 mol %.

9. The method according to claim 1, wherein the anionic additive is added in an amount maintaining a sum of added charges from cationic polymer(s) and anionic additive net cationic.

10. The method according to claim 1, wherein the anionic additive is added separately from the at least one cationic polymer.

11. The method according to claim 1, wherein the at least one cationic polymer is cationic starch or cationic synthetic strength polymer.

12. The method according to claim 1, wherein the at least one cationic polymer is cationic starch added in an amount of 3-20 kg/t.

13. The method according to claim 1, further comprising adding one or more auxiliary agents to the feed water, the one or more auxiliary agents being selected from alum or anionic microparticles.

14. The method according to claim 13, wherein the anionic microparticles are anionic silica microparticles or bentonite microparticles.

15. The method according to claim 1, wherein the at least first and/or the second layer comprises anionic microparticles and cationic synthetic flocculant.

16. The method according to claim 1, wherein the at least first and/or the second layer comprises recycled cellulosic fibres.

* * * * *